US006866408B1

(12) United States Patent
Albou

(10) Patent No.: US 6,866,408 B1
(45) Date of Patent: Mar. 15, 2005

(54) MOTOR VEHICLE HEADLAMP OF THE ELLIPTICAL TYPE CAPABLE OF EMITTING A BEAM WITHOUT CUT-OFF

(75) Inventor: Pierre Albou, Paris (FR)

(73) Assignee: Valeo Vision, Bobigny Cedex (FR)

( * ) Notice: Subject to any disclaimer, the term of this patent is extended or adjusted under 35 U.S.C. 154(b) by 0 days.

(21) Appl. No.: 09/499,984

(22) Filed: Feb. 8, 2000

(30) Foreign Application Priority Data

Feb. 9, 1999 (FR) ..... 99 01496

(51) Int. Cl.[7] ..... F21V 7/00

(52) U.S. Cl. ..... 362/518; 362/487; 362/507; 362/517; 362/543; 362/346; 362/245

(58) Field of Search ..... 362/518, 487, 362/507, 517, 543, 346, 245, 347

(56) References Cited

U.S. PATENT DOCUMENTS

| | | | | |
|---|---|---|---|---|
| 4,517,630 A | * | 5/1985 | Dieffenback et al. | 362/268 |
| 5,285,362 A | * | 2/1994 | Sakata | 362/263 |
| 5,636,917 A | | 6/1997 | Furami et al. | |
| 5,897,196 A | * | 4/1999 | Soskind et al. | 362/61 |
| 6,152,589 A | * | 11/2000 | Kawaguchi et al. | 362/518 |
| 6,155,702 A | * | 12/2000 | Blusseau | 362/520 |

FOREIGN PATENT DOCUMENTS

| | | |
|---|---|---|
| EP | 0 254 746 | 2/1988 |
| FR | 2 552 528 | 3/1985 |
| FR | 2704044 | 10/1994 |

OTHER PUBLICATIONS

Patent Abstracts of Japan, vol. 014, No. 006(M–916), Jan. 9, 1989 and JP 01 255103A (Koito Mfg Co Ltd) Oct. 12, 1989.

French Search Report No. 15 Sep. 1999.

* cited by examiner

*Primary Examiner*—Stephen Husar
*Assistant Examiner*—Anabel Ton
(74) *Attorney, Agent, or Firm*—Morgan & Finnegan, LLP

(57) ABSTRACT

A motor vehicle headlamp comprises a light source, a reflector possessing first and second focal regions, and a converging lens. The source is located in the first focal region and the lens possesses a focus situated in the second focal region. The reflector and the lens have axes which are essentially coincident defining the optical axis of the headlamp. The headlamp is intended to generate a light beam exhibiting high intensity along the optical axis and a limited extension below the optical axis. A first area of the reflector extending in the vicinity of an axial vertical plane generates, in a focal plane of the lens, images of the source the center which is substantially offset with respect to the focus of the lens, while two second areas of the reflector located on either side of said first area generate, in the same focal plane, images of the source the centers of which pass close to or onto the focus of the lens.

14 Claims, 5 Drawing Sheets

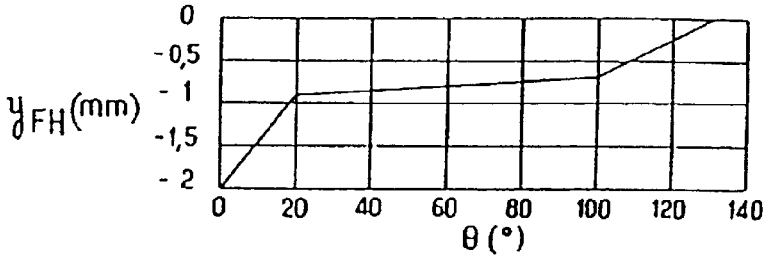
FIG_12
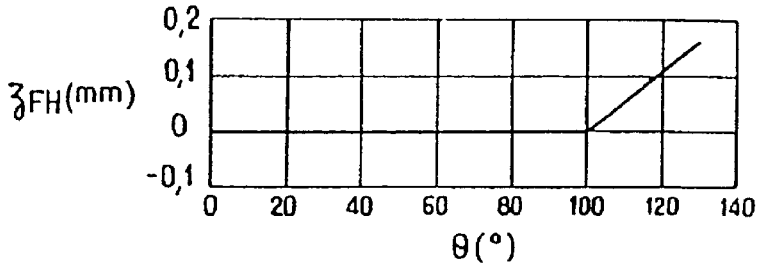
FIG_13
FIG_14
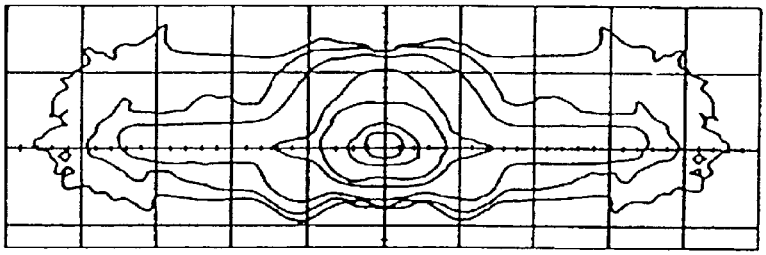
FIG_15
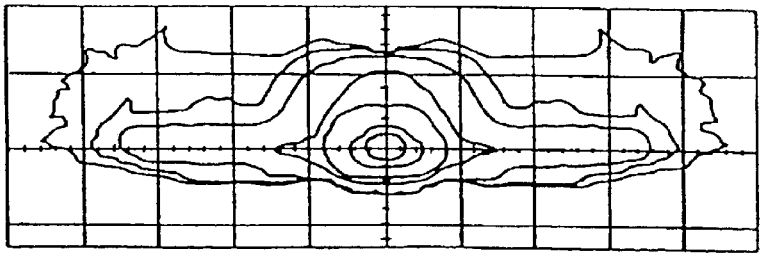

MOTOR VEHICLE HEADLAMP OF THE ELLIPTICAL TYPE CAPABLE OF EMITTING A BEAM WITHOUT CUT-OFF

FIELD OF THE INVENTION

The present invention relates in a general way to headlamps of the elliptical type for motor vehicles.

BACKGROUND OF THE INVENTION

An elliptical headlamp conventionally comprises a light source such as an incandescent filament or the luminescent arc of a discharge lamp, this source being located in a first focal region of a mirror so that the light reflected by it is directed towards a second focal region situated in front of the first one. A lens, generally plano-convex, is focused on this second focal region, so as to project the light spot formed in said second focal region onto the road.

This light spot can be modeled, for example with a mask, to form a beam with cut-off as required, such as a dipped beam, an upper edge of this mask defining the profile of this cut-off.

Because of this possibility of forming a sharp cut-off, and because of the excellent recovery by the mirror of the light flux emitted by the source, such headlamps have been used successfully for many years to form dipped European beams with cut-off in a "V" shape.

To form the main beam, it is usual to provide another headlamp, dedicated to this function and generally including a parabolic mirror focused on another source. Headlamps of the elliptical type are in fact somewhat unsuitable for producing a main beam, since it can be difficult, in the axis of the road, to obtain the illumination minima required by the regulations or the technical specifications. In particular, the beam formed by a headlamp of the elliptical type exhibits fairly regular brightness, with no marked point of concentration at its center, and a complex contour particularly with substantial overthickness towards the top and towards the bottom in terms of the optical axis, which has the drawback of illuminating the road too close to the vehicle. In contrast, a parabolic mirror makes it possible to have an extremely large amount of light available in the axis and just below it.

Hence a vehicle equipped with elliptical dipped headlamps possesses separate, dedicated main-beam headlamps, which naturally increases the manufacturing cost of the set of headlights and their size on the front of the vehicle. In particular, the necessity to provide dipped and main-beam headlamps with fundamentally different principles means that recourse is had to designs and to sets of tools (moulds, presses, etc.) which are completely specific, which contributes to this high overall manufacturing cost. Moreover, when it is turned off, the external appearance of an elliptical headlamp is very different from that of a parabolic headlamp, which can impair the aesthetics of the frontal region of the vehicle.

DISCUSSION OF THE INVENTION

It is an object of the present invention to remedy these limitations of the state of the art, and to propose a headlamp of the elliptical type for a main beam which can repeat a certain number of elements, and in particular the lens and the intermediate component between mirror and lens, of a dipped headlamp and which, in consequence of a special-purpose design of the mirror, can generate a completely satisfactory main beam.

Hence the present invention relates to a motor vehicle headlamp, comprising a light source, a mirror possessing first and second focal regions, and a converging lens, the source being located in the first focal region and the lens possessing a focus situated in the second focal region, the mirror and the lens having axes which are essentially coincident defining an optical axis of the headlamp, and the headlamp being intended to generate a light beam exhibiting high intensity along the optical axis and a limited extension below the optical axis, characterized in that a first area of the mirror extending in the vicinity of an axial vertical plane is able to generate images of the source the center which is substantially offset with respect to the focus of the lens, and in that two second areas of the mirror which are situated on either side of said first area are able to generate images of the source the centers of which pass close to or onto the focus of the lens.

Preferred, but not limiting, aspects of the headlamp according to the invention are as follows:

- the centers of the images of the source which are generated by the first area in the focal plane of the lens are offset laterally with respect to the focus of the lens.
- the mirror possesses, in correspondence with a reference focus situated in the vicinity of the source, a vertical focusing area extending substantially horizontally and transversely to the optical axis, substantially at the height of the latter, the first area of the mirror reflects the radiation towards regions of the focusing area which are remote from the optical axis, and the second areas of the mirror reflect the radiation towards a region of the focusing area situated in the vicinity of the optical axis.
- the centers of the images of the source which are generated by the first area in the focal plane of the lens are offset downwards with respect to a horizontal line passing through the focus of the lens.
- the reflecting surface of the mirror is constructed from axisymmetric ellipsoidal sections possessing a first reference focus situated in the vicinity of the source and a second reference focus situated in a vertical focusing area extending substantially horizontally and transversely to the optical axis, substantially at the height thereof, and the first area possesses a part situated above the optical axis and a reference focus or a set of reference focuses of which is situated behind a reference focus or behind a set of reference focuses of the second areas, and a part situated below the optical axis and a reference focus or a set of reference focuses of which is situated in front of said reference focus or of said set of reference focuses of the second areas.
- within the first area, the position of the reference focuses varies progressively in proportion with the lateral spacing from the optical axis.
- within the second areas, the position of the reference focuses varies progressively with the lateral spacing from the optical axis.
- the mirror moreover possesses two third areas situated respectively outside the two second areas, and these third areas are configured so that the radiation which they reflect encounters the entry face of the lens.
- the centers of the images of the source which are generated by the third areas in the focal plane of the lens are offset upwards or downwards with respect to a horizontal line passing through the focus of the lens.
- at least one of the areas of the mirror possesses a reference focus or a set of reference focuses which is offset upwards or downwards with respect to a reference focus or to a set of reference focuses of at least one other area.

the third areas of the mirror possess a reference focus or a set of reference focuses which is offset upwards or downwards with respect to a reference focus or to a set of reference focuses of the second areas.

the headlamp moreover comprises a mask upwardly delimiting the light spot intended to be projected by the lens.

the mask extends with an offset, in the direction of the optical axis, with respect to the focus of the lens.

Other aspects, objectives and advantages of the present invention will emerge better on reading the following detailed description of a preferred embodiment thereof, given by way of non-limiting example and with reference to the attached drawings.

BRIEF DESCRIPTION OF THE DRAWINGS

FIG. 15 illustrates the profile of the beam generated by this same headlamp, implementing the variant of FIG. 9.

DESCRIPTION OF THE PREFERRED EMBODIMENTS OF THE INVENTION

Figure 1:
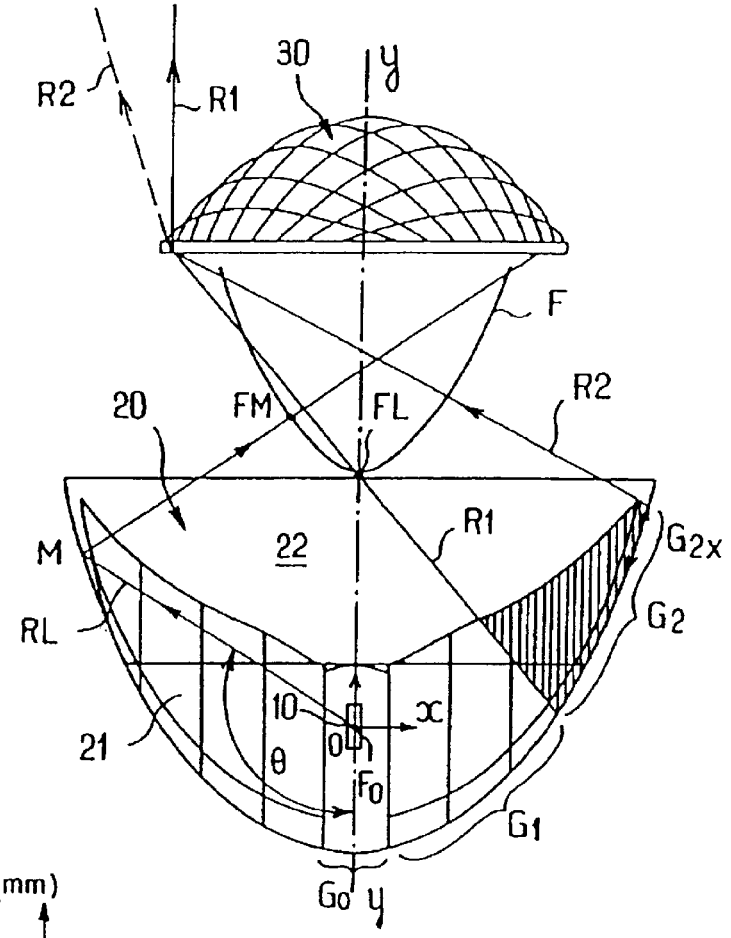
FIG. 1 is a partial view in axial horizontal section of a headlamp according to the invention, FIG. 2 graphically illustrates a law of the change in reflection by the mirror as a function of the angle, in projection in the axial horizontal plane, of the light beam emitted by the source.

Referring first to FIG. 1, a headlamp has been represented partially and diagrammatically, this headlamp comprising a light source 10, in this instance the filament of an incandescent lamp (or in a variant the arc of a discharge lamp), a mirror 20 and a plano-convex lens 30.

A right-angled reference system (0, x, y, z) is defined here, the center 0 of which constitutes a reference focus F0 of the mirror, in which the 0x direction is horizontal and perpendicular to the general direction of emission of the light, in which the 0y direction defines this general direction of emission or optical axis, and in which the 0z direction is vertical.

The mirror 20, with axis y—y, is of the ellipsoidal type, and possesses a usable reflecting surface 21 and upper and lower cheeks 22.

The usable surface possesses a first focal region (namely the reference focus F0) in which the source 10 is situated, and a second focal region situated further forward than the focus F1 on the y—y axis, in which is concentrated the radiation output by the source 10 after reflection on the mirror. In the present example, this mirror is as described in the document FR-A-2 704 044 in the name of the Applicant, to which reference will be made for all the details of its construction, such that the second focal region consists of a vertical focusing line F which, in this instance, extends symmetrically on either side of the optical axis y—y and with a curved shape the concavity of which is directed outwards. This vertical focusing line is the set of the convergence locuses, in vertical planes, of the rays emitted by vertical slices of the mirror.

In order particularly to limit the overall depth of the headlamp, it is advantageous to position the focusing line F situated close to the front edge 23 of the mirror 20, as illustrated.

As for the lens 30, it possesses a focus FL and a focal plane perpendicular to the optical axis and containing the focus FL, and is positioned in such a way that its focus FL is situated substantially at the intersection of the focusing line F and of the optical axis y—y, so as to project onto the road the image of the light spot formed in this region.

In accordance with the teachings of FR-A-2 704 044, the mirror is designed in particular in such a way that all the light rays (RL) emitted towards the mirror from the reference point F0 and contained in a vertical plane forming an angle θ with respect to the axial vertical plane y0z are, after reflection, concentrated at a defined place (point FM) of the curve F, and the mirror can be designed in such a way as to obtain laws of progression of the locus of the point FM as a function of the value of θ which are of absolutely any sort. This is obtained by arranging for the cross section of the mirror in the axial vertical plane of angle θ to be identical to the cross section, in the same plane, of an axisymmetric ellipsoid with focuses F0 and FM.

It will be understood here that, by varying these laws, it is possible to model the light spot in the region of the focus of the lens 30, and hence the photometry of the projected beam. In particular, it is possible, for a given angle θ and hence for a given average size of the images of the source, to choose a point FM situated either on the focus FL, or situated laterally, on one side or the other, spaced away from it.

In order to give the projected beam its range, it is necessary to generate a high intensity in the axis of the road. The lens 30, though, projects into the axis of the road only the rays which pass through its focus FL. Hence, in the mirror, areas are defined which are capable of reflecting the rays in such a way that, on the one hand, they pass through the focus FL, that is to say through the intersection of the curve F and of the y—y axis, and that, on the other hand, they encounter the entry face of the lens 30, and other areas for which the reflected rays which would pass through the focus FL would not encounter the entry face of the lens, and would therefore be lost. These other areas are therefore designed in such a way as to cause the light to converge on locuses of the curve F such that these rays encounter the entry face of the lens 30.

In FIG. 1, for the right-hand half of the mirror, areas G0 and G1 have been plotted, these areas belonging to the first category, and the area G2 which belongs to the second category. Corresponding areas exist in the left-hand half of the mirror, this being produced symmetrically with respect to the plane y0z. In FIG. 1 are also plotted examples of rays R1 and R2 which are reflected by the inner and outer edge areas, respectively, of this area G2. The ray R1 passes again through the focus FL (this makes it possible to ensure continuity of the join between the areas G1 and G2) and encounters the lens in the vicinity of its opposite edge, while the ray R2 encounters the lens in this same region, crossing the curve F a long way from the point FL.

If this area G2 is examined, it will be understood that it produces images of the source 10 which are at the same time small and slightly inclined with respect to the horizontal; it will also be understood that the lens 30 projects these images at infinity with more or less significant horizontal deviations.

As for the area G0, it is located at the back of the mirror 20. It will be understood that it produces images of the source which are essentially vertical and of large size.

If the rays corresponding to these images are sent back to the focus FL, then the beam projected will, because of the accumulation of such images in the axis of the road, exhibit a very great thickness, called "flame" of light, which will strongly illuminate the road very close to the vehicle, which is unacceptable for visual comfort since vision in the far distance is then greatly degraded.

Hence, according to a preferred characteristic of the mirror according to the invention, the area G0 is designed so that at least a substantial part of the radiation which it reflects passes some distance away from the focus FL as it is propagated. In that way, a part of the large vertical images is displaced laterally, away from the main illumination field of the headlamp, so as not to disturb vision in the far distance.

The respective widths of the areas G0 and G1 are chosen as a compromise between a substantial width for the area G0 which contributes to spacing away the large vertical images or images slightly inclined with respect to the vertical, and a substantial width for the areas G1, which contributes to giving the beam its range in the axis.

Figure 2:
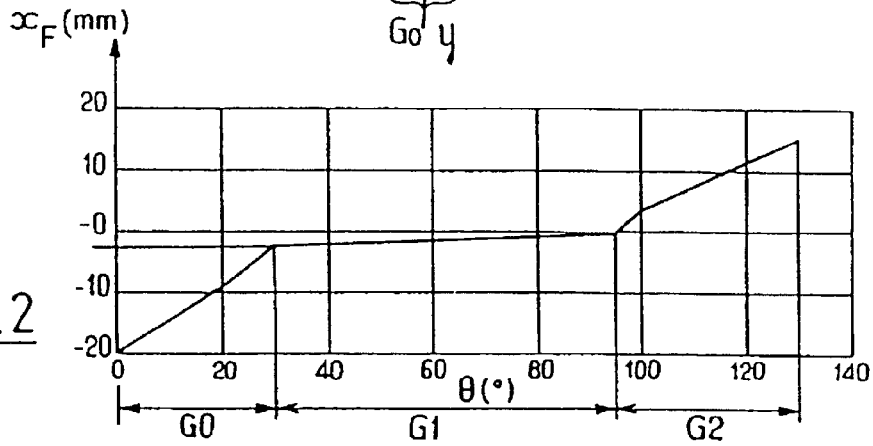

FIG. 2 is a curve illustrating an example of the light distribution achieved in accordance with the invention. This curve gives the setting $x_F$ of the intersection of the light reflected with the curve F, as a function of the angle E of the ray emitted from the reference point 0 with respect to the reference direction 0y directed towards the back of the mirror ($\theta$=0).

Figure 3:
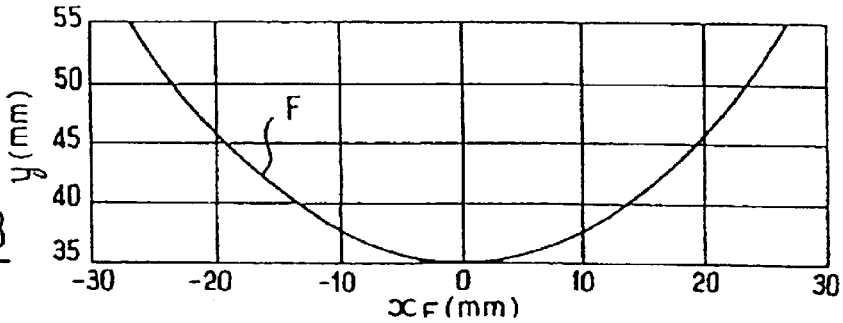
FIG. 3 illustrates the profile of a vertical focusing line specific to the mirror of the headlamp.

FIG. 3 illustrates the profile of this curve F, in the form $Y_F$=f ($x_F$)

It is seen in FIG. 2 that, as regards the area G0, the setting $X_F$ varies progressively from −20 mm to about −2 mm, for $\theta$ varying from 0° to 30°, this angle of 30° here being the site of the boundary between the areas G0 and G1.

In this way, the images emitted by the back of the filament will be found to be very much displaced laterally with respect to the optical axis, and progressively less and less displaced in proportion as the angle $\theta$ increases.

In the area G1, which is covered by $\theta$ angles varying between 30° and about 94°, the setting $x_F$ varies progressively from −2 mm to 0 mm, which means that the whole of the radiation reflected by this area passes onto or very close to the focus FL of the lens, so as consequently to be projected in the axis of the road or very slightly inclined with respect to this axis.

Finally the area G2, which here covers the angles lying between 94° and 130°, reflects the radiation over $x_F$ settings varying progressively from 0 to 15 mm, this progression, in conjunction with the abovementioned angular range, being determined so that all the rays reflected actually encounter the entry face of the lens 30.

Figure 4:
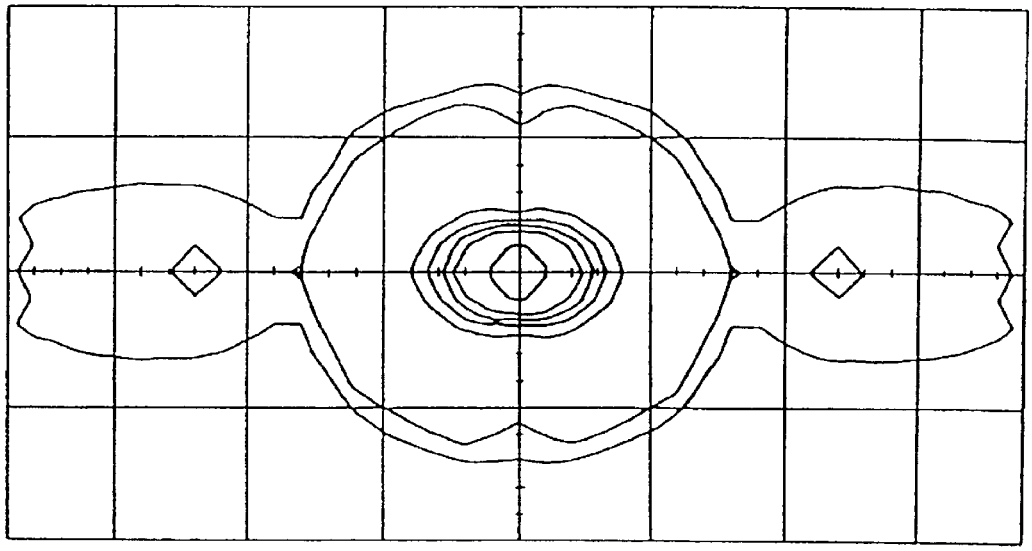
FIG. 4 illustrates the profile of a light beam obtained with the mirror having the properties illustrated in FIGS. 2 and 3.

The profile of the beam projected onto the road with such a mirror is illustrated in FIG. 4 by a set of isocandela curves. It will be observed that there is a good point of concentration in the axis, and a brightness of the beam above and below the axis which is reduced by virtue of the shifting of a substantial quantity of light towards the left and right sides thanks primarily to the area G0.

Such a beam can be further improved, as will now be described, by reducing the quantity of light in line with the optical axis, that is to say illuminating the road too close to the vehicle. In contrast, the "bulge" of light above the optical axis is much less troublesome, since it essentially illuminates the sky and does not substantially impair the view of the road in the far distance.

Figure 5:
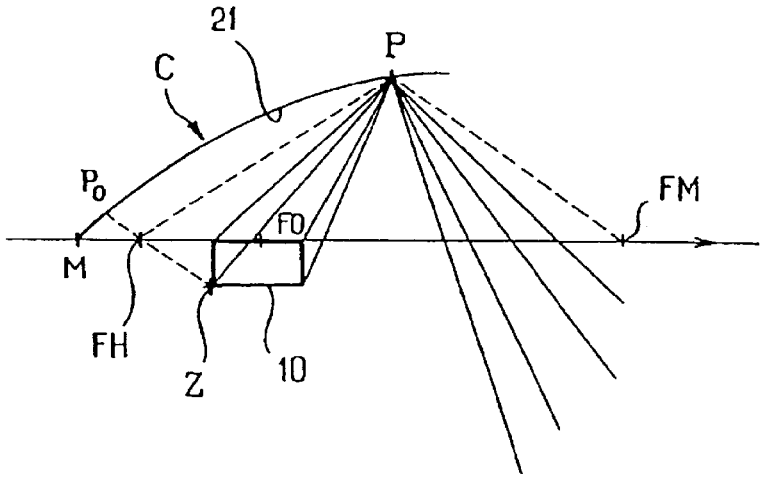
FIG. 5 is a diagrammatic view in partial axial vertical section illustrating the mode of construction of an upper part of the mirror in order to correct the height of the images of the source, FIG. 6 graphically illustrates a law of the change in the upper focuses in the axial direction, specific to this mode of construction.

Hence, FIG. 5 illustrates a diagrammatic vertical section of the source 10 and of the mirror 21, in a plane $\pi_m$ containing a set of rays which are reflected by a cross section C of the mirror passing through a point M and contained in this same plane (the source 10 is illustrated here in projection in this plane). In the surfaces described in the abovementioned document FR-A-2 704 044, such a vertical cross section of the mirror is identical to that of an ellipsoid the first focus of which is situated at F0 and the second focus of which is situated at the point FM situated on the focal line F.

If, now, a similar surface is constructed, but with the first focus of the ellipsoid no longer being placed at point F0, but at a point FH situated between the point F0 and the back of the mirror, then it can be understood that, in a plane of projection perpendicular to the optical axis and passing through the point FM, the image of the filament generated by a point $P_0$ which is at the intersection between a straight line passing through the lower rear corner Z of the source 10 and the focus FH, on the one hand, and the cross section C of the mirror on the other hand, touches the point FM while extending entirely below it, whereas the images of the filament which are generated by points situated between the point M and the point $P_0$ extend straddling the horizontal straight line contained in this plane and passing through the point FM.

All the other images of the source, for their part, are situated entirely below this same straight line.

Hence it can be understood that, if, in the design of the mirror, the reference F0 is replaced by a reference FH which is set back with respect to F0, then the light emitted is lowered overall (and thus raised up after projection by the lens).

That said, an improvement of the mirror of the headlamp according to the present invention consists in causing the position of the reference focus FH to change as a function of the angle $\theta$ of the light rays emitted towards the mirror.

More precisely, if a reference focus FH is used which is relatively set back for the area G0 of the mirror, it will be possible to raise the generally vertical large images which illuminate the road too close to the vehicle, whereas if a reference focus FH is used which is close to the center of the filament for the area G2, the smaller and less vertical images of the source will be found to be placed close to the horizon. The area G1, for its part, may exhibit reference focuses occupying intermediate positions.

Moreover, it is advantageous, in order to contribute to the homogeneity of the beam, to control the position of the focuses FH which are specific to each cross section of the mirror, in such a way that this position changes continuously as a function of the value of the angle θ.

Figure 6:
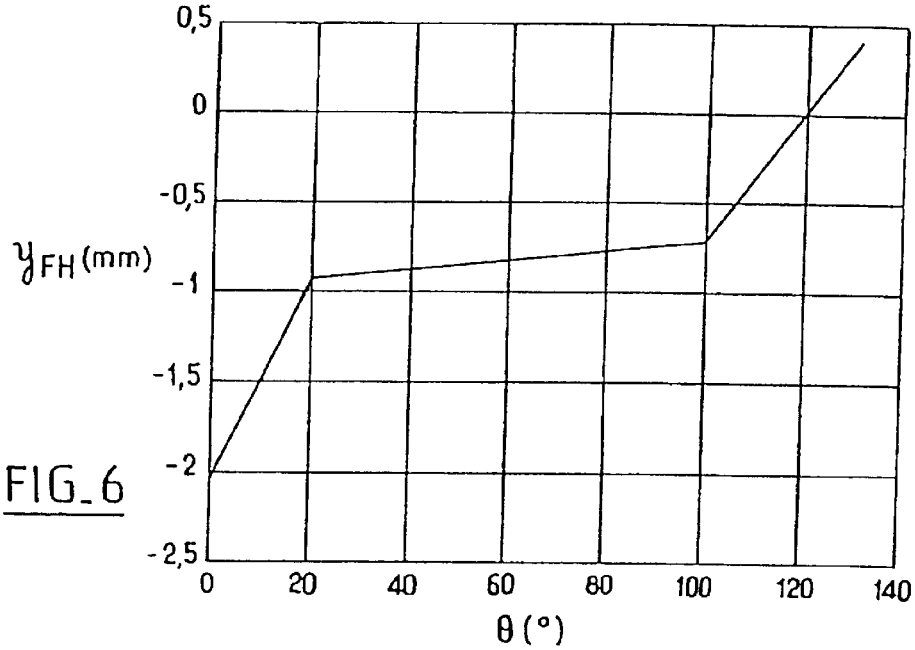

Hence, FIG. 6 illustrates an example of such a progression, in which the x axis illustrates the value of θ in degrees, while the y axis illustrates the relative setting $y_{FH}$ of the reference focus FH for the cross section in question with respect to the center of the filament (zero setting).

It will be observed that the setting changes progressively, within the area G0, between a strongly negative value (−2 mm, i.e. about half the length of the filament) and an intermediate value (about −0.9 mm); it changes more slowly, within the area G1, between the abovementioned value and a value slightly closer to the center of the filament (about −0.7 mm); finally, in the area G2, the position of the focus FH passes progressively from this value to a positive value of about +0.4 mm, passing locally through the zero setting.

It will be observed here, referring again to FIG. 4, that relying on a focus FH with positive setting for a part of the area G2 makes it possible, in contrast to what is observed for the negative settings, to lower certain small-sized images of the filament, particularly in order to supplement the beam below the horizon, as well as to enhance the complementarity between dipped beam and main beam when the main-beam function is implemented while leaving the dipped headlamp lit.

Figure 7:
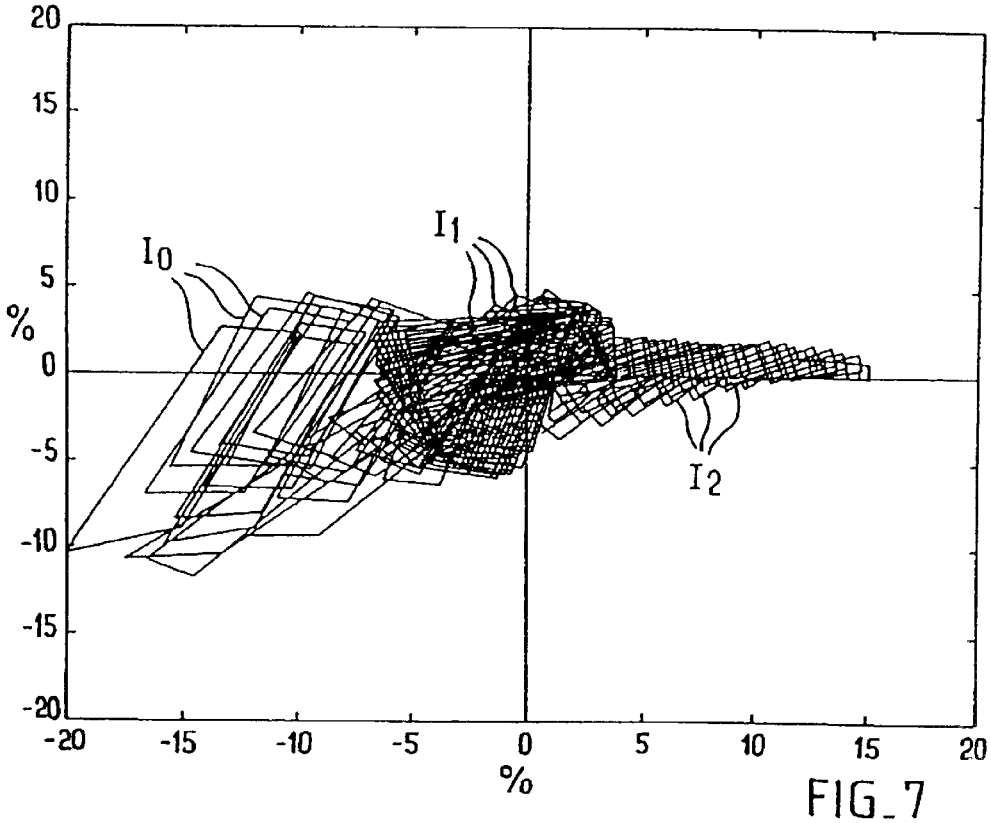
FIG. 7 illustrates the layout of a certain number of images of the source, in a transverse projection plane, which are generated by the mirror defined in accordance with FIGS. 6 and 7.

FIG. 7 illustrates the distribution of a certain number of images of the filament with the control of the focuses FH as illustrated in FIG. 6. The images 10, 11 and 12 are those which are generated respectively by the areas G0, G1 and G2 of the mirror. It is observed particularly in this figure that, in the axis of the road, the concentrated light spot no longer extends to more than about 5% below the horizon.

Figure 8:
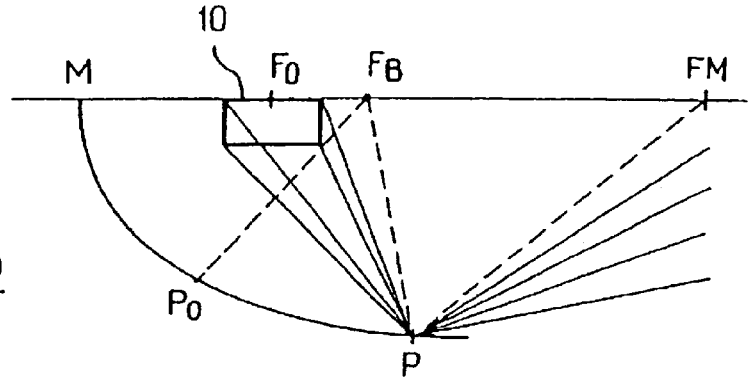
FIG. 8 is a view similar to FIG. 5, illustrating the construction of the lower part of the mirror.

The description given above deals with the part of the upper half of the mirror which corresponds to positive θ angles. The laterally opposite part is preferably produced symmetrically. As for the lower half of the mirror, it is produced by having recourse to a reference focus FB which is no longer set back, but brought forward with respect to the source (see FIG. 8), preferably with a similar control law for its setting along the y—y axis, so as thus to obtain similar behavior. For preference, $y_{FB}(\theta)=-y_{FH}(\theta)$ is set.

According to one improvement of the above-described embodiment, recourse may be had to a mask in order to eliminate certain parts of undesirable images from the beam and, in particular, as indicated above, parts of certain large images slightly inclined with respect to the vertical. In this respect, it should be noted that it is possible, with difficulty, in the case of the area G0, to place the upper and lower reference focuses FH and FB at too great a distance from the rear and front extremities, respectively, of the filament, since then the images generated by the areas of the mirror having such reference focuses will be substantially remote from the optical axis, and the maximum illumination will no longer be found in the axis of the road, which is contrary to the basic photometric principles of a main beam.

Figure 9:
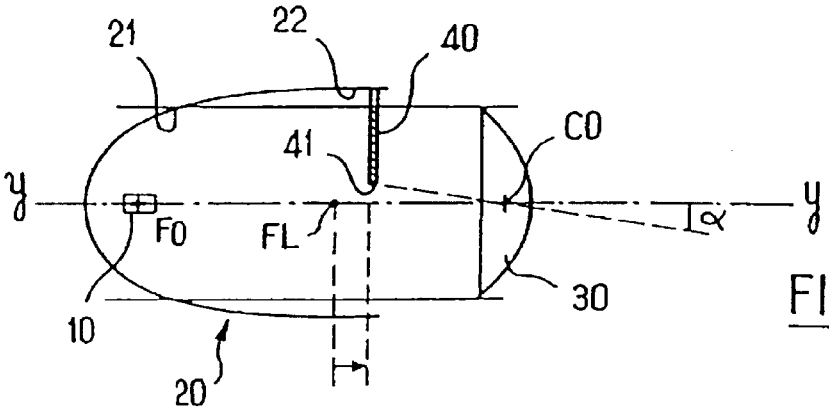
FIG. 9 is a diagrammatic view in axial vertical section of a variant of the headlamp according to the invention, FIG. 10, via a set of isocandela curves, illustrates the profile of the beam generated by the headlamp as defined by reference to FIGS. 1 to 8, FIG. 11, in the same manner, illustrates the profile of the beam generated with a similar headlamp in accordance with the variant of FIG. 9, FIG. 12 graphically illustrates a variant of the law of change in the upper focuses in the axial direction of FIG. 6, FIG. 13 graphically illustrates a law of change in the upper focuses in the vertical direction supplementing the law of change of FIG. 2, FIG. 14, via a set of isocandela curves, illustrates the profile of the beam generated by a headlamp according to FIGS. 1 to 8, having parameters in accordance with FIGS. 12 and 13.

Hence, by reference now to FIG. 9, an improvement of the above-described embodiment consists in resorting to a mask in order to eliminate certain troublesome images from the beam.

More precisely, on this figure are illustrated the source 10, the mirror 20, the lens 30 and its optical center CO, and a mask 40 which extends vertically between the mirror and the lens, substantially in line with the focus FL of said lens. The position of the lower edge 41 of the mask is chosen in such a way as to shade an upper part of the light spot formed in the vicinity of the focus FL, that is to say a lower part of the projected beam. Advantageously, this lower edge, as illustrated, occupies a position such that the straight line which passes through this edge and through the optical center CO of the lens forms an angle α of about 3 to 5% with respect to the optical axis y—y, this being done so as to shade the light emitted downwards with an angle greater than a with respect to the horizon.

Moreover, in order to avoid the lower edge 41 of the mask 40 giving rise to an abrupt cut-off of the light along this inclination, which is a source of discomfort to the driver, provision is made to place the mask 40 in a plane which is offset by a distance d typically of a few millimetres, preferably forwards, with respect to the vertical plane containing the focus FL. The light cut-off caused by the mask is thus given a fuzzy character suitable for preventing this problem.

Moreover, the mask 40 may occupy only a part of the width of the light spot formed by the mirror and intended to be projected by the lens, in particular if it is wished not to impair the lateral parts of the beam.

Figure 10:
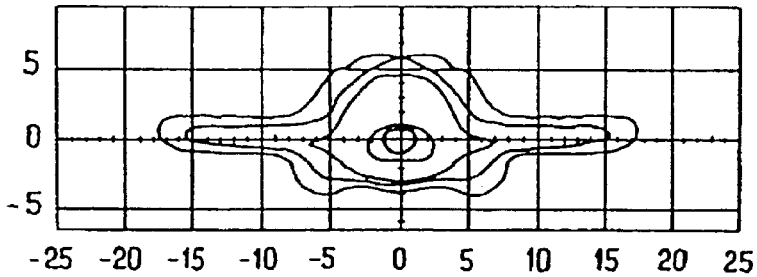
Figure 11:
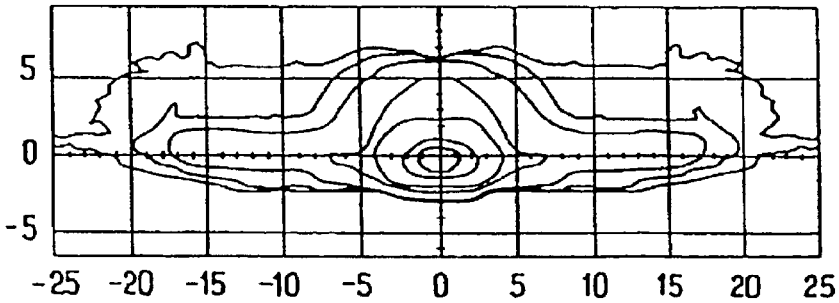

FIGS. 10 and 11 illustrates the profile of the projected beam, respectively without the mask 40 and with the mask 40 (and with the control of the upper and lower focuses as described above). It will be observed that the "bulges" of light directed downwards in the case of FIG. 10, contributing to illuminating the road too close to the vehicle, have disappeared in FIG. 11.

The headlamp as described by reference to FIGS. 5 et seq. may be further improved, in certain situations, by influencing the vertical setting (z coordinate) of the upper and lower reference focuses of the vertical cross sections of the mirror.

More precisely, although the upper and lower focuses may, in the case of the G0 and G1 areas of the mirror, have vertical co-ordinates $z_{FH}$ and $z_{FS}$ which remain zero over the entire extent of these areas, it is possible to make provision, in the area G2 which generates principally small images of the source which are essentially horizontal or in any event greatly inclined with respect to the vertical, to have recourse to non-zero vertical co-ordinates $z_{FH}$ and $z_{FB}$.

In particular, recourse to such a vertical offsetting of the upper and lower focuses makes it possible, if necessary, to raise these small images (that is to say to lower them after projection by the lens 30). This may prove to be worthwhile in the case in which the images generated by the area G0, after projection by the lens, adopt too high a position which causes an excessive reduction in the luminous intensity in the axis, the fact of lowering the small images makes it possible to compensate for this loss of intensity.

The vertical offsetting of the reference focuses in the area G2 also makes it possible to raise the images generated by this area (after projection by the lens), so that they overlap the horizon line, in a relatively balanced way. This may prove to be useful when the choice of $y_{FH}$ and $Y_{FB}$ in the area G2 leads to a lowering of the images which it generates.

FIGS. 12 and 13 illustrate an example of control of the position of the reference focuses along the y—y axis and along the z—z axis, respectively. The control along the y—y axis is similar to that of FIG. 6, except that, in the area G2, the range covered is different ($y_{FH}$ varies from −0.7 mm to 0 mm). Control along the z—z axis here concerns only the area G2, and it is observed that, as the angle θ describes the area G2, the position of the upper reference focus is progressively raised up so as to reach a maximum offset of about 0.15 mm.

FIG. 14, via a set of isocandela curves, illustrates the profile of the beam obtained, while FIG. 15 illustrates the profile of the beam obtained with the same control of the reference focuses, and additionally with the mask illustrated in FIG. 9.

Obviously, the present invention is not in any way limited to the embodiments described and represented, but the person skilled in the art will be able to apply any variant or modification in accordance with its spirit.

What is claimed is:

1. A motor vehicle headlamp, comprising a light source, a reflector having first and second focal regions, and a converging lens, the light source being located in the first focal region and the lens possessing a focus situated in the second focal region, the reflector and the lens having axes which are essentially coincident defining an optical axis of the headlamp, the reflector comprising a first area extending in the vicinity of an axial vertical plane, said first area generating, in a focal plane of the lens, images of the light source having centers which are substantially offset with respect to the focus of the lens, the reflector further comprising two second areas which are situated on either side of said first area for generating, in the focal plane of the lens, second images of the right source having centers which pass close to or onto the focus of the lens, whereby the headlamp generates a light beam exhibiting high intensity along the optical axis and a limited extension below the optical axis.

2. A headlamp as claimed in claim 1, wherein the centers of the images of the light source which are generated by the first area in the focal plane of the lens are offset laterally with respect to the focus of the lens.

3. A headlamp as claimed in claim 2, wherein the reflector possesses, in correspondence with a reference focus situated in the vicinity of the light source, a vertical focusing area extending substantially horizontally and transversely to the optical axis, substantially at the height of the optical axis, wherein the first area of the reflector reflects the radiation towards regions of the focusing area which are remote from the optical axis, and wherein the second areas of the reflector reflect the radiation towards a region of the focusing area situated in the vicinity of the optical axis.

4. A headlamp as claimed in claim 1, wherein the centers of the images of the light source which are generated by the first area in the focal plane of the lens are offset downwards with respect to a horizontal line passing through the focus of the lens.

5. A headlamp as claimed in claim 4, wherein the reflecting surface of the reflector is constructed from axisymmetric ellipsoidal sections possessing a first reference focus situated in the vicinity of the light source and a second reference focus situated in a vertical focusing area extending substantially horizontally and transversely to the optical axis, substantially at the height thereof, and wherein the first area possesses a part situated above the optical axis and a reference focus or a set of reference focuses of which is situated behind a reference focus or behind a set of reference focuses of the second areas, and a part situated below the optical axis and a reference focus or a set of reference focuses of which is situated in front of said reference focus or of said set of reference focuses of the second areas.

6. A headlamp as claimed in claim 5, wherein, within the first area, the position of the reference focuses varies progressively in proportion with the lateral spacing from the optical axis.

7. A headlamp as claimed in claim 5, wherein, within the second areas, the position of the reference focuses varies progressively with the lateral spacing from the optical axis.

8. A headlamp as claimed in claim 1, wherein the reflector further possesses two third areas situated respectively outside the two second areas, and wherein these third areas are configured so that the radiation which they reflect encounters the entry face of the lens.

9. A headlamp as claimed in claim 8, wherein the centers of the images of the light source which are generated be the third areas in the focal plane of the lens are offset upwards or downwards with respect to a horizontal line passing through the focus of the lens.

10. A headlamp as claimed in claim 5, wherein at least one of the areas of the reflector possesses a reference focus or a set of reference focuses which is offset upwards or downwards with respect to a reference focus or to a set of reference focuses of at least one other area.

11. A headlamp as claimed in claim 8, wherein at least one of the areas of the reflector possesses a reference focus or a set of reference focuses which is offset upwards or downwards with respect to a reference focus or to a set of reference focuses of at least one other area.

12. A headlamp as claimed in claim 11, wherein the third areas of the reflector possess a reference focus or a set of reference focuses which is offset upwards or downwards with respect to a reference focus or to a set of reference focuses of the second areas.

13. A headlamp as claimed in claim 1, further comprising a mask upwardly delimiting a light spot intended to be projected by the lens.

14. The headlamp as claimed in claim 13, wherein the mask extends with an offset, in the direction of the optical axis, with respect to the focus of the lens.

* * * * *

UNITED STATES PATENT AND TRADEMARK OFFICE

CERTIFICATE OF CORRECTION

PATENT NO. : 6,866,408 B1
DATED : March 15, 2005
INVENTOR(S) : Albou

It is certified that error appears in the above-identified patent and that said Letters Patent is hereby corrected as shown below:

Column 9,
Line 32, “right source” should read, -- light source --.

Column 10,
Line 28, “generated be” should read, -- generated by --.

Signed and Sealed this

Sixteenth Day of August, 2005

JON W. DUDAS
*Director of the United States Patent and Trademark Office*